United States Patent [19]

Gessner

[11] 4,417,628

[45] Nov. 29, 1983

[54] EARTH BORING APPARATUS

[76] Inventor: Richard W. Gessner, 1038 Eleventh St. NE., Massillon, Ohio 44646

[21] Appl. No.: 308,280

[22] Filed: Oct. 5, 1981

[51] Int. Cl.[3] ..... E21B 7/02

[52] U.S. Cl. ..... 173/29; 173/22; 173/46; 173/159; 37/117.5; 248/674

[58] Field of Search ..... 173/22, 27, 29, 31, 173/46, 159; 37/117.5; 175/62; 248/223.4, 224.2, 225.2, 674, 675; 299/67

[56] References Cited

U.S. PATENT DOCUMENTS

| | | | |
|---|---|---|---|
| 2,969,844 | 1/1961 | Hamrick | 173/159 X |
| 2,998,215 | 8/1961 | Brown | 248/674 |
| 3,017,935 | 1/1962 | Galbraith et al. . | |
| 3,038,546 | 6/1962 | Blubaugh . | |
| 3,043,032 | 7/1962 | Discenza | 37/117.5 |
| 3,129,013 | 4/1964 | Thompson et al. . | |
| 3,132,701 | 5/1964 | Juntunen . | |
| 3,289,852 | 12/1966 | Kahn | 248/224.2 X |
| 3,327,789 | 6/1967 | Furuseth . | |
| 3,669,035 | 6/1972 | Grossman | 248/225.2 X |
| 3,835,623 | 9/1974 | Kline | 248/224.2 X |
| 3,927,315 | 12/1975 | Werry | 248/223.4 X |
| 4,087,010 | 5/1978 | Stormon | 299/67 X |
| 4,125,952 | 11/1978 | Jennings | 37/117.5 |
| 4,360,980 | 11/1982 | Jarvis | 37/117.5 |

FOREIGN PATENT DOCUMENTS

| | | | |
|---|---|---|---|
| 2830802 | 1/1979 | Fed. Rep. of Germany | 299/67 |

*Primary Examiner*—James G. Smith
*Assistant Examiner*—Robert P. Olszewski
*Attorney, Agent, or Firm*—Wilson, Fraser, Barker & Clemens

[57] ABSTRACT

An apparatus for boring horizontally extending holes at shallow depths beneath the surface of the earth having a frame detachably connected to the bucket of a backhoe. The frame is rigidly connected to the bucket for movement thereby and includes a coupling and drive unit which is detachably mounted within the frame so that the coupling and drive unit can be reversed to push or pull an auger connected thereto in opposite directions relative to the bucket.

7 Claims, 8 Drawing Figures

EARTH BORING APPARATUS

BACKGROUND OF THE INVENTION

1. Field of the Invention

This invention generally relates to improvements in earth boring apparatus, and more particular, to an attachment for use with a backhoe in boring shallow depth, substantially horizontal holes through the earth.

2. Description of the Prior Art

As is well known in the installation of utility services, it is frequently necessary or desirable to extend service transmission lines at shallow depths beneath the surface of the earth underneath sidewalks, driveways and the like. Various types of devices have been devised in the past for forming horizontally extending bores through the earth, but most of these prior art devices are complicated, cumbersome to use and expensive as such devices have been designed to be affixed directly to the boom of a vehicular means such as a backhoe. Such structures require specially designed attaching means wherein the bucket must be removed from the boom for attaching the boring devices thereto.

Accordingly, it is desirable to produce a boring attachment, that includes a earth boring device, which is easily connected to the bucket of a backhoe or the like.

SUMMARY OF THE INVENTION

As contemplated by the invention, an earth boring apparatus is directly connectable to a conventional backhoe bucket and generally includes a rotatably driven auger, means for driving the auger and means for detachable securing the driving means to the bucket. More specifically, the means for detachable securing the driving means to the bucket includes a frame means which is adapted to be rigidly secured to the bucket.

In one embodiment, the frame means includes an upper portion which is adapted to snugly engage the marginal reinforcing flanges surrounding the walls defining the opening of the backhoe bucket and the back surface of the bucket teeth for providing a stiff, rigid extension on which the driving means is detachably mounted. An elongate rod extending across the upper frame portion, projects through apertures provided in the side walls of the bucket and the upper portion for rigidly locking the frame means to the bucket.

In another embodiment, the frame means includes an upper horizontal plate for contacting the outer curvature of the bucket. A pair of positionable hooks are pivotablly mounted along one side of the plate for engaging the cutting edge of the bucket between the teeth. A length of chain is anchored to one corner on the opposed side of the plate. The chain is passed through a tensioning device mounted on the pin attaching the piston rod of the actuating cylinder to the bucket. The free end of the chain is detachably secured to the other corner of the opposed side. By this structural arrangement, the frame means may be quickly and securely attached to the backhoe bucket.

In both embodiments a surface engaging skid, affixed to the lower end of the frame means, supports the frame, driving means and auger from the bottom surface of a hole provided for producing the subsurface, horizontally extending bore in the earth. The means for detachable mounting the driving means to the frame means includes a plate which directly absorbs thrust loads produced by the driven auger and transmits such loads to the frame.

BRIEF DESCRIPTION OF THE DRAWINGS

The above as well as other objects of the invention will become readily apparent to one skilled in the art from reading the following detailed description of the preferred embodiments of the invention when considered in the light of the accompanying drawings in which.

DETAILED DESCRIPTION OF THE PREFERRED EMBODIMENTS

Figure 1:
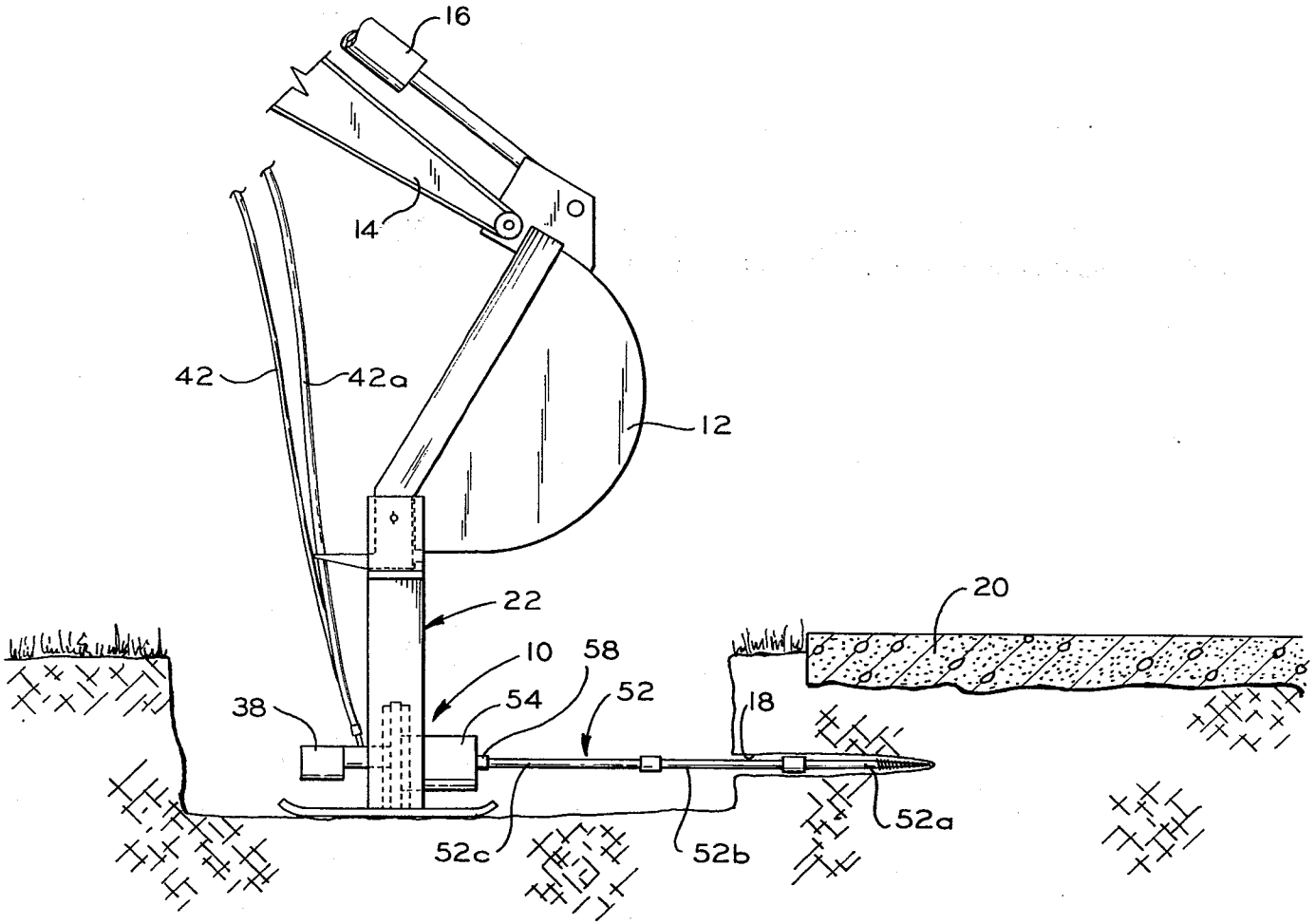
FIG. 1 is a perspective view illustrating the earth boring attachment attached to the bucket of a backhoe in accordance with the present invention.

Referring now to FIG. 1, wherein like reference numerals designate similar parts throughout, there is illustrated an earth boring apparatus 10 adapted to be detachably secured to a bucket 12 of a conventional backhoe (not shown) or like vehicular means, as it would appear in actual use. As illustrated therein, the earth boring attachment 10 is detachably secured to the bucket 12 which is pivotally mounted on the end of a boom 14. The attitude and reach of the bucket 12 is adjusted by an actuating cylinder 16. Accordingly, the position of the earth boring apparatus 10 is controlled by movement of the bucket 12 and is primarily employed in boring horizontally extending holes such as hole 18 at a desired shallow depth beneath a driveway 20 or the like, for placing cables and etc. below the surface of the earth.

Figure 2:
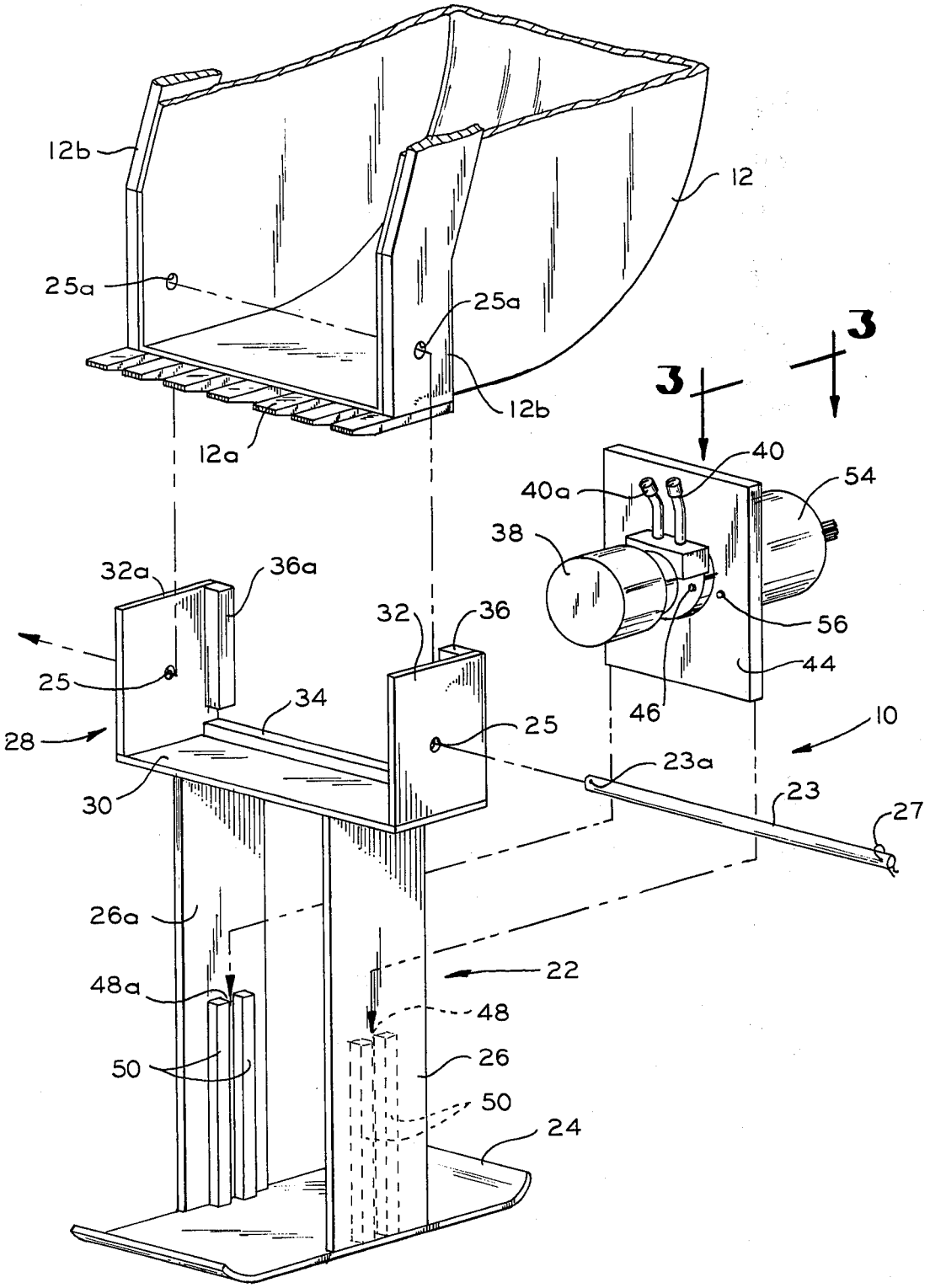
FIG. 2 is an enlarged, exploded perspective view of the earth boring attachment illustrated in FIG. 1.

Referring particularly to FIG. 2, the earth boring apparatus 10 generally includes a vertically disposed, frame means 22 (preferably a weldment structure) having a lower surface engaging skid 24, a pair of rectangularly shaped upright members 26 and **26*a* affixed to the mid section of the skid 24 and bucket attaching means 28 affixed to the upper ends of the members 26 and 26*a*. More specifically, the attaching means 28 includes a horizontally extending web 30 affixed, in a symmetrical manner, to the upper ends of the upright members 26 and 26*a*. A pair of spaced apart vertically extending members 32 and 32*a* are respectively affixed to the ends of the web 30 for forming a U-shaped configuration. An abutment flange 34 extends along one marginal edge of the web 30 and a pair of vertically extending abutment flange 36 and 36*a* respectively extend along the adjacent marginal edge of each vertical member 32 and 32*a***, the purpose of which will be described hereinafter.

As is conventional in the construction of earth scooping buckets, the bucket 12 includes spaced digging teeth **12*a* extending along one edge and stiffening flanges 12*b*** extending around the open, marginal side edges of the bucket 12. Accordingly, the spacing between the inner facing surfaces of the vertical members 32 and 32*a* and the thicknesses of the flanges 34, 36 and 36*a* is designed to correspond to the spacing between the opposite outside surfaces of the side wall bucket flanges 12*b* and the thicknesses of the bucket teeth 12*a* and stiffening flanges 12*b*, respectively. In this manner, the flanges 34, 36 and 36*a* will abut the adjacent back surfaces of the bucket teeth 12*a* and the bucket flanges 12*b* when the frame means 22 is mounted thereon. The frame means 22 is secured to the bucket 12 by an elongate rod 23 extending through aligned apertures 25 and 25*a* provided in each vertical member of the attaching means 28 and the side walls of the bucket 12, respectively. The rod 23 is held in assembled relation thereto by lock pins 27 extending through holes 23*a* provided in each end of the rod 23.

A motor, such as a hydraulic motor 38 or the like, is detachably mounted at the bottom portion of the frame means 22 adjacent the skid 24 and is connected to a source of fluid power provided by the backhoe tractor (not shown) by the way of fittings 40 and 40*a* and hoses 42 and 42*a* respectively, extending along the boom 14 (see FIGS. 1 and 2). The motor 38 is secured to a mounting plate 44 by a plurality of cap screws 46 (only one shown in FIG. 2). The opposite vertical marginal edges of the mounting plate 44 are telescopically received in opposed vertically disposed guideways 48 and 48*a* each defined by pairs of spaced upright bar members 50 affixed to the inner facing surfaces of the upright plates 26 and 26*a* adjacent the skid 24. It will be noted that mounting plate 44 may be pushed or pulled by the frame 22 and can be removed from the guideways and reversed for producing the bore hole 18 in either axial direction.

As best illustrated in FIG. 1, an earth boring auger 52 having multiple segments 52*a*, 52*b* and 52*c*, but not limited to that number, is coupled to the driven output shaft of the motor 38 by a direct drive coupling 54. The direct drive coupling 54 is mounted on the face opposite the face on which the motor 38 is mounted (See FIGS. 2 and 3) by cap screws 56.

Figure 3:
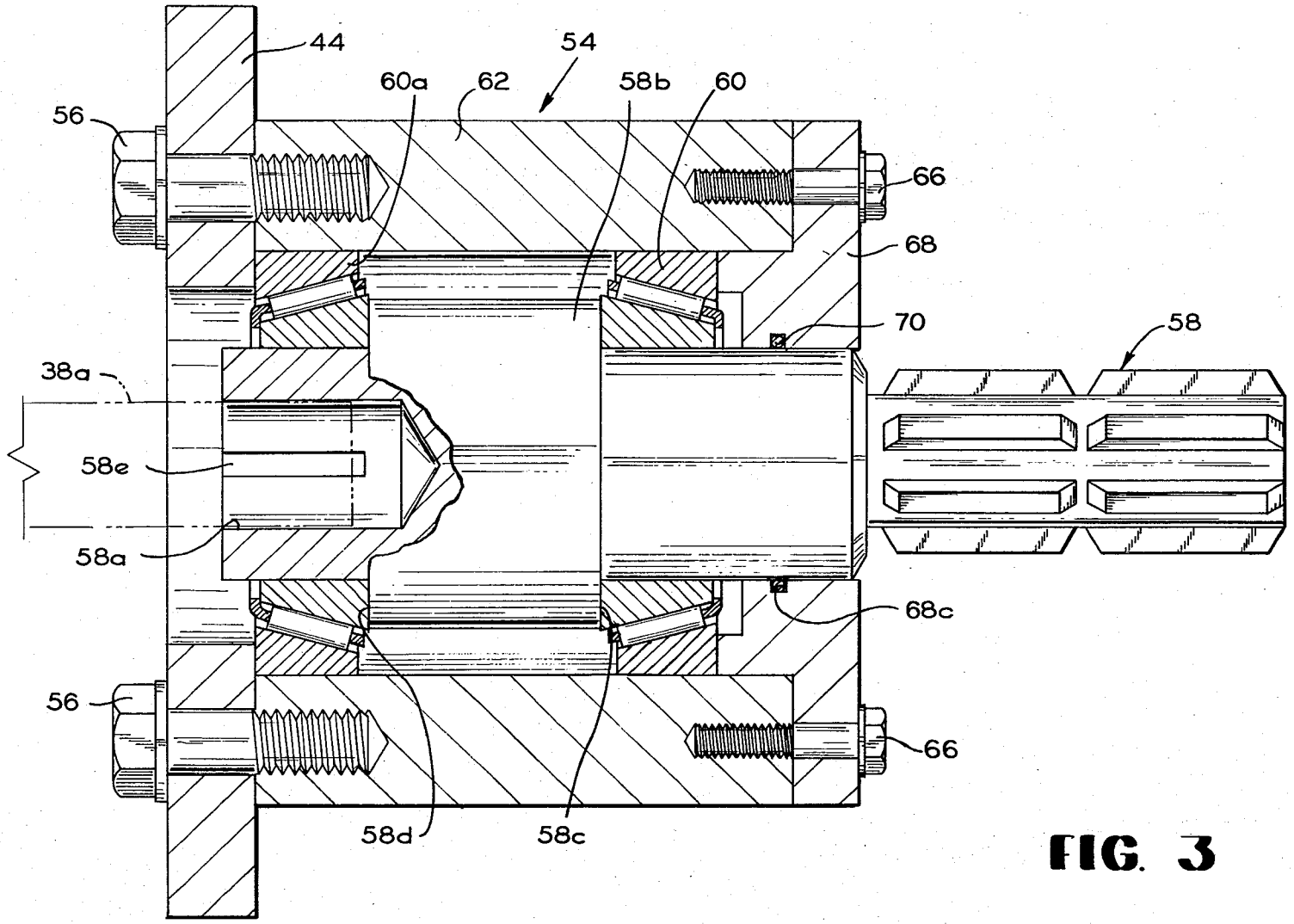
FIG. 3 is a partial cross-sectional view of the power drive unit taken substantially along line 3—3 of FIG. 2.

Referring to FIG. 3, the direct drive coupling 54 includes an externally splined output shaft 58 journalled for rotation in spaced taper roller bearings 60 and 60*a* mounted in an annular housing 62. The end of the output shaft 58, contained within the housing 62, is provided with a bore 58*a* for receiving the output shaft 38*a* of the motor 38. A key (not shown) disposed in the motor shaft 38*a* and seated in a keyway 58*e* provided in the bore 58*a*, locks the spline shaft 58 thereto for rotation. It will be noted that the shaft 38*a* is spaced from the bottom of the bore 58*a* so that no axial thrust loads can be transmitted between the motor 38 and the coupling 54. The output shaft 58 is provided with an enlarged portion 58*b* whose opposed faces 58*c* and 58*d* each seat one of the taper bearings 60 and 60*a*, respectively. A retainer 68 secured to the annular housing 62 as by cap screws 66, has a portion abutting the bearing 60 and secures the assembly against the mounting plate 44. An O-ring seal 70 disposed within an internal groove 68*a* provided in the retainer 68 prevents the ingress of dirt into and egress of lubricant from the coupling 54.

Figure 4:
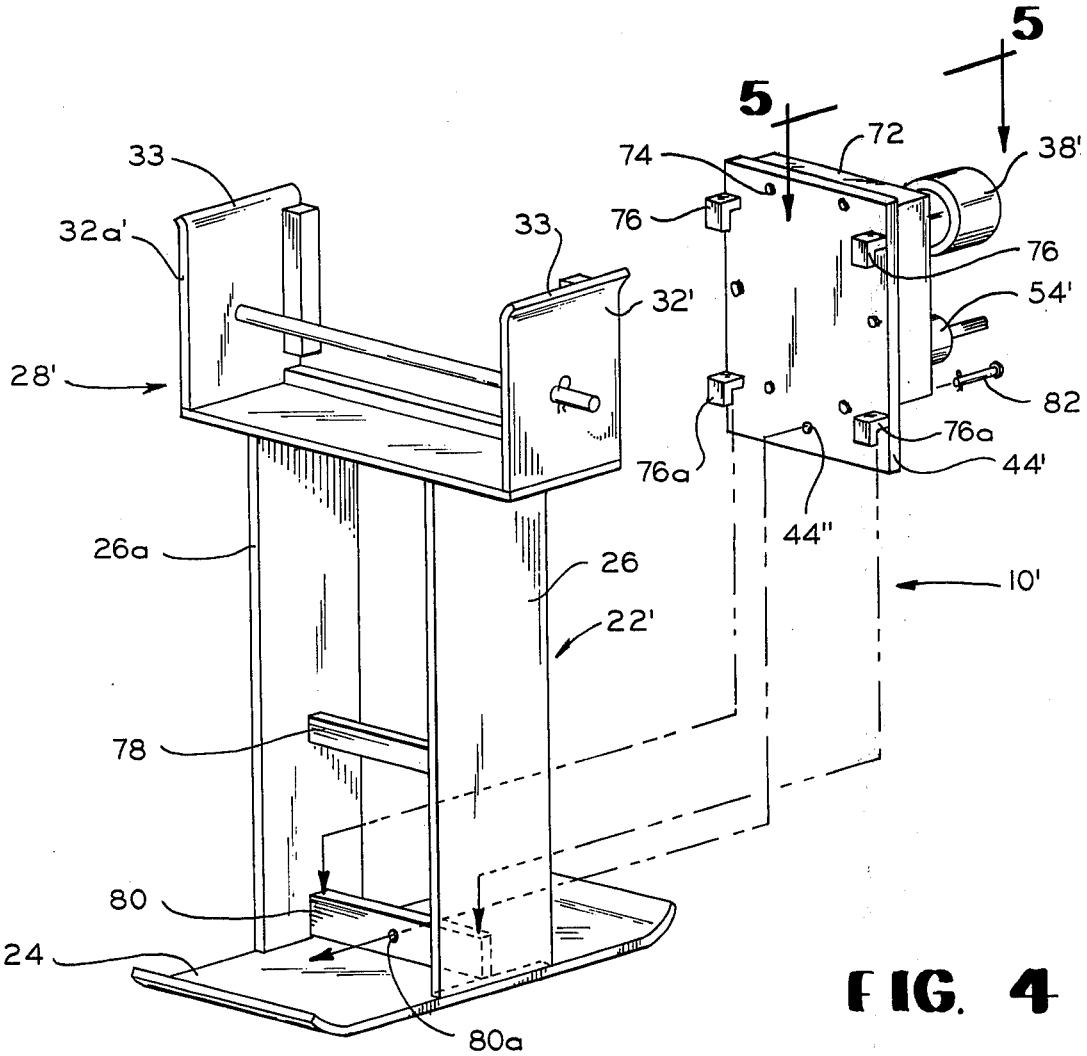
FIG. 4 is an exploded perspective view of another embodiment of the earth boring attachment.

In the embodiment of the earth boring apparatus 10' illustrated in FIG. 4, the structure of the frame means 22' is substantially the same as the structure of the frame means 22 previously described. The frame means 22' only differs in two respects, one is the top marginal edge of each vertical member 32' and 32*a'* of the attaching means 28' is outwardly flared as at 33, for guiding the bucket 12 into the means 28'. In the other respect, the guideways 48 and 48*a* are replaced by horizontally extending, vertically spaced bars 78 and 80, the purpose of which will be described hereinafter.

A hydraulic motor 38' and a coupling 54' are commonly affixed on the outer face of a box type housing 72 secured, as by cap screws 74, to a mounting plate 44', one above the other. The opposite face of the mounting plate 44' is provided with two pairs of spaced downwardly depending hook members 76 and 76*a* which cooperate with the horizontally disposed bars 78 and 80 respectively, extending between an affixed to the inner surfaces of the upright plates 26 and 26*a* of the frame means 22'. A locking pin 82 is received in aligned apertures 44'' and 80*a* provided in the mounting plate 44' and the frame bar 80 respectively, for locking the members together. In most other respects, the boring apparatus 10' is the same as previously described for the boring apparatus 10.

Figure 5:
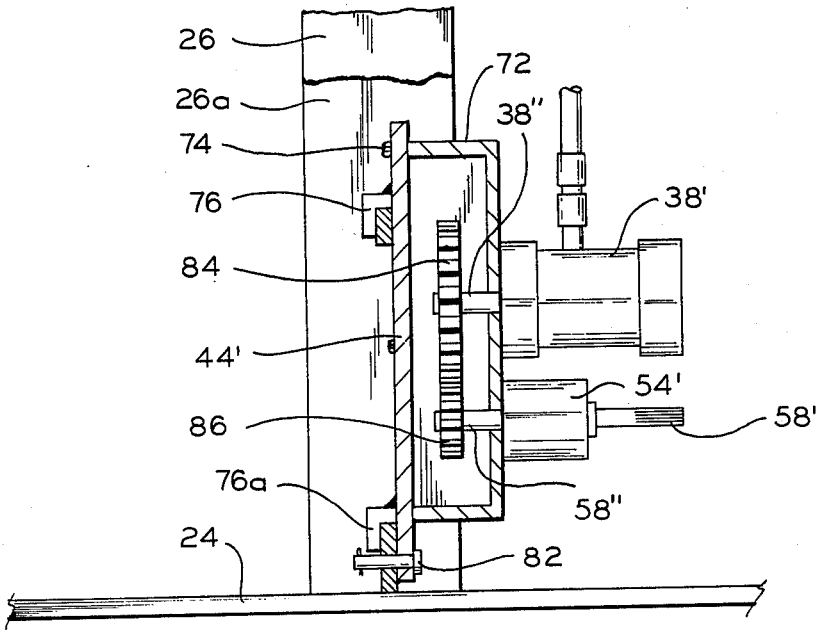
FIG. 5 is a partial cross-sectional view of the power drive unit illustrated in FIG. 4 and taken substantially along line 5—5 thereof.

Referring now to FIG. 5, the motor 38' drivingly rotates the coupling 54' through intermeshing gears 84 and 86 keyed to the output shaft 38'' of the motor 38' and an extending portion 58'' of the output shaft 58', respectively. However, other types of suitable drive mechanisms may be substituted for the intermeshing gears 84 and 86.

Figures 6, 7:
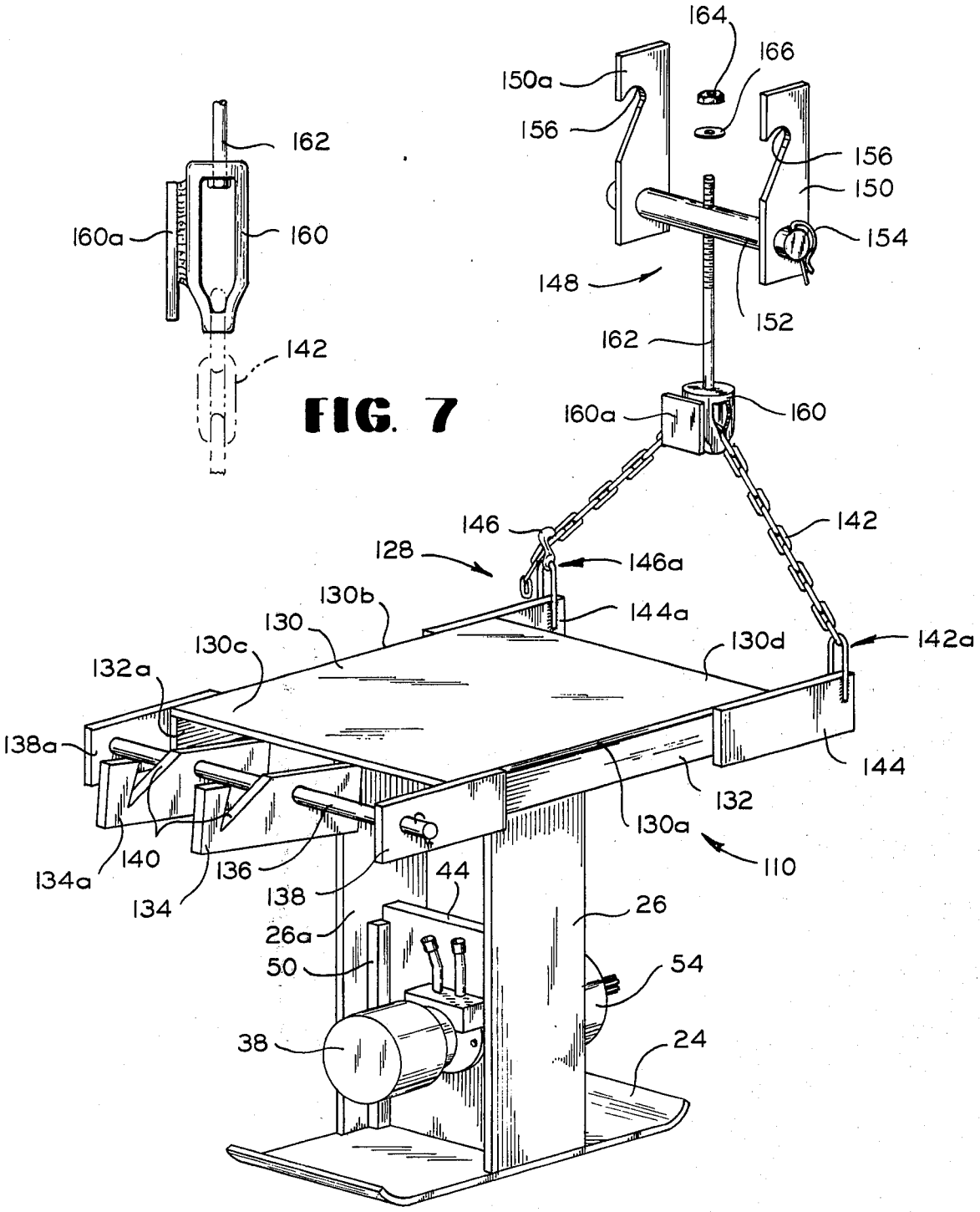
FIG. 6 is a partially exploded perspective of another embodiment of an earth boring attachment.
FIG. 7 is an enlarged fragmentary perspective view of the lower portion of the tensioning device.
Figure 8:
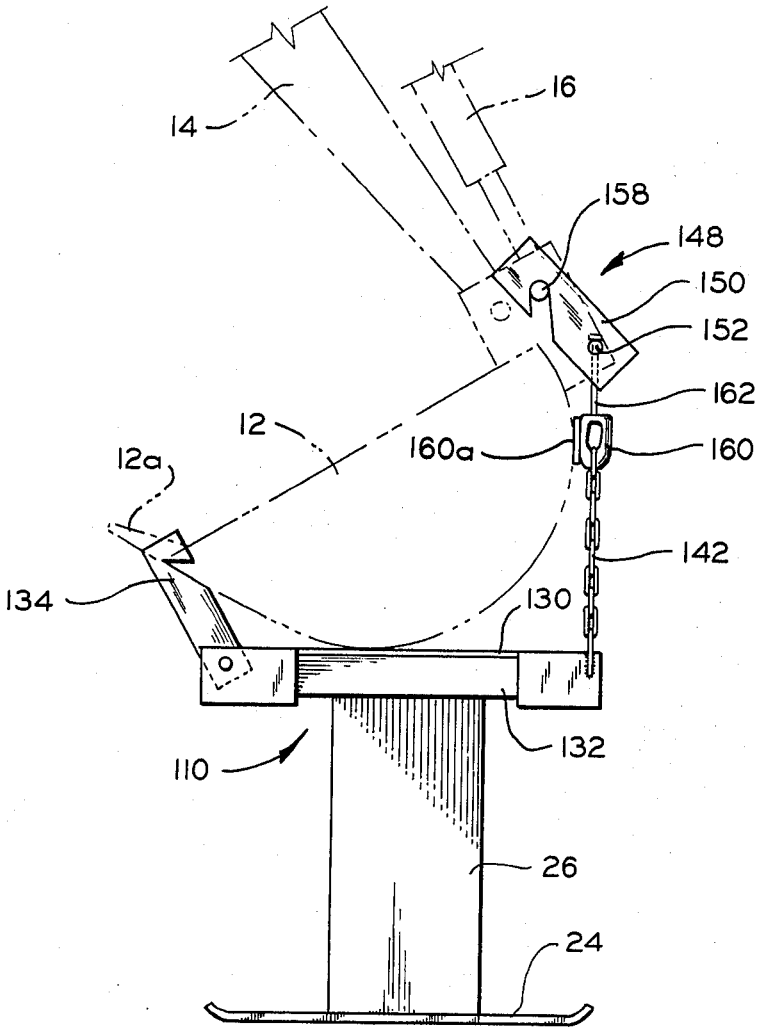
FIG. 8 is a side elevational view illustrating the frame means attached to a bucket shown in phantom.

Referring now to FIGS. 6 through 8, there is illustrated an earth boring apparatus 110 which is substantially the same as the embodiment shown in FIG. 2 except for the bucket attaching means 128. Accordingly, only the bucket attaching means 128 will be described as the previous description and reference numbers employed for the embodiment illustrated in FIG. 2 will suffice for the similar elements.

As illustrated, the bucket attaching means 128 includes a horizontally disposed, rectangular plate 130 having depending side flanges 132 and 132*a* extending along the opposite sides 130*a* and 130*b*, respectively. The mid portion of the plate 130 is affixed, in a symmetrical manner, to the upper ends of the upright members 26 and 26*a*.

Two spaced hooks 134 and 134*a* are pivotally mounted on a transversely extending rod 136. The rod 136 is mounted at one end 130*c* of the plate 130 in brackets 138 and 138*a* projecting beyond the flanges 132 and 132*a*, respectively. Each hook 134 and 134*a* is slidable along the rod 136 and each is provided with a V-shaped notch 140 for engagement with the cutting edge of the bucket 12 between the teeth 12*a* (see FIG. 8).

A length of chain 142 is provided at the opposite end 130*d* of the plate 130 for attaching the frame means to the bucket 12. More particularly, one end of the chain 142 is anchored as at 142*a* to a bracket 144 extending beyond the rail 132. A chain hook 146 is attached, as at 146*a*, to a bracket 144*a* extending beyond the flange 132*a*.

As best illustrated in FIG. 8, a curl pin hook device 148 is provided for securing the apparatus 110 to the bucket 12. Referring now to FIG. 6, the hook device 148 includes a pair of hooks 150 and 150*a* pivotally mounted on a rod 152. Locking pins 154 (only one shown) are provided at the ends of the rod 152 for retaining the hooks on the rod. Each hook 150 and 150*a* is provided with a notch 156 for engagement with a curl pin 158 conventionally forming part of the bucket operating mechanism.

An eye bracket 160 provided with a pad 160*a*, is dependingly mounted on an elongated threaded member 162 slidably passing through the rod 152. The member 162 is moved relative to the rod 152 by a nut 164 normally seated against a washer 166.

In attaching the apparatus 110 to the bucket 12, the curved portion of the bucket is first set on the plate 130. Next the hooks 134 and 134*a* are moved to a position between the bucket teeth 12*a* to engage the cutting edge of the bucket. The curl pin device 148 is then attached to the bucket's curl pin 158 where it is free to pivotally move. The chain 142 is then passes through the eye bracket 160 and pulled taut until the curved portion of the bucket snugly engages the plate 130 as well as the pad 116*a* of the eye bracket 160. The free end of the chain is secured by the hook 146. The nut 164 is then tightened drawing up the eye bolt 160 and tensioning the chain 142 until the apparatus 110 is rigidly attached to the bucket.

One of the advantages of the afore-described coupling structure mounting is that axial thrust loads are accommodated by the coupling and transmitted directly to the plate and frame means without transmitting such loads to the motor. Accordingly, the useful life of the earth boring apparatus is substantially increased before repairs or replacement of the components may be repaired.

In use, the earth boring apparatus is capable of being readily positioned in a relatively short, shallow trench such as illustrated in FIG. 1, adjacent the driveway 20 under which the bore hole 18 is to be formed. In operation, the rotatably driven earth auger 52 is moved forwardly or rearwardly, as the case may be, by manipulation of boom 14 of the bucket operating mechanism. When the auger section 52*a* is fully extended into the bore hole 18, it is uncoupled from the coupling output shaft 58 and an additional length of shaft such as the section 52*b* is added. Then, the boring cycle is continued until the desired length of the bore hole 18 is achieved.

In accordance with the provisions of the patent statutes, the principles and mode of use of the invention has been explained and what is considered to represent its preferred embodiments have been illustrated and described. It should, however, be understood that the invention may be practiced otherwise and as specifically illustrated and described without departing from its spirit and scope.

What is claimed is:

1. A boring apparatus having a rotatably driven auger for use in combination with a bucket pivotly attached to a movable boom of a vehicular means, comprising:

(a) an open upstanding frame means including a pair of spaced upright members and an upper bucket attaching means;

(b) means for detachably connecting said upper bucket attaching means to the bucket with said pair of spaced upright members extending outwardly of the bucket;

(c) a mounting plate extending between said pair of upright members;

(d) means for removably affixing said mounting plate to said pair of spaced upright members whereby said mounting plate can be installed in one of two positions;

(e) coupling means affixed to said mounting plate; and (f) power drive means affixed to said mounting plate for rotatingly driving said coupling means whereby said mounting plate can be installed to operate the auger for producing a bore hole in either axial direction with respect to the bucket.

2. The invention defined in claim 1 wherein said upper bucket attaching means comprises a generally U-shaped member fixedly secured to the upper ends of said pair of upright members and having abutment means extending along one marginal edge engageable with cooperating abutment surfaces on the bucket and a rod extending through aligned apertures provided in said U-shaped member and the bucket for securing the engagement of said abutment means with the cooperating surfaces of the bucket whereby said open upstanding frame means is rigidly held against the outer surface of the bucket.

3. The invention defined in claim 1 wherein said upper bucket attaching means comprises a flat plate engageable with an outer surface of the bucket and fixedly secured to the upper end of said pair of upright members, hook means pivotally mounted on one edge of said flat plate and engageable with the cutting edge of the bucket and adjustable tie means affixed to and extending between the opposite ends of said flat plate and the pivotal end of the bucket whereby said flat plate of said open upstanding frame means is rigidly held against the outer surface of the bucket.

4. The invention defined in claim 3 wherein said adjustable tie means comprises a chain secured to the corners of said flat plate, an eye bracket including an elongated threaded member pivotally attached to the pivotal end of the bucket and through which said chain passes and nut means for drawing said eye bracket toward the pivotal connection of the bucket for tensioning said chain whereby said flat plate is drawn into rigid engagement with the bucket.

5. The invention defined in claim 1 wherein said open upstanding frame means includes a lower surface engaging skid fixedly secured to the lower ends of said pair of spaced upright members.

6. The invention defined in claim 1 wherein said means for removably affixing said mounting plate to said pair of spaced upright members comprises vertically disposed guideways affixed to the opposed inner surfaces of said upright members for receiving opposed vertically edges of said mounting plate.

7. The invention defined in claim 1 wherein said means for removably affixing said mounting plate to said pair of spaced upright members comprises a pair of vertically spaced horizontally extending bars affixed to the inner surfaces of said upright members and said mounting plate includes at least two vertical similarly spaced, depending hook members engageable with said horizontally extending bars.

* * * * *